US010947872B1

(12) United States Patent
Augustin, Sr.

(10) Patent No.: US 10,947,872 B1
(45) Date of Patent: Mar. 16, 2021

(54) ON-ENGINE LUBRICATION FLUID STORAGE SYSTEM

(71) Applicant: Cummins Inc., Columbus, IN (US)

(72) Inventor: Kevin C. Augustin, Sr., Greenwood, IN (US)

(73) Assignee: Cummins Inc., Columbus, IN (US)

( * ) Notice: Subject to any disclaimer, the term of this patent is extended or adjusted under 35 U.S.C. 154(b) by 0 days.

(21) Appl. No.: 16/569,121

(22) Filed: Sep. 12, 2019

(51) Int. Cl.
*F01M 11/02* (2006.01)
*F01M 11/00* (2006.01)

(52) U.S. Cl.
CPC . *F01M 11/0004* (2013.01); *F01M 2011/0041* (2013.01); *F01M 2011/0095* (2013.01)

(58) Field of Classification Search
CPC ..... F01M 11/02; F01M 11/0004; F01M 2011/0095; F01M 2011/023; F01M 11/00
See application file for complete search history.

(56) References Cited

U.S. PATENT DOCUMENTS 1,874,103 A 6/1928 Fredrick
1,866,280 A 7/1932 Woolson
1,989,816 A * 2/1935 Meyer ..... F01M 11/065 184/6.2
3,590,953 A 7/1971 Wellauer
4,825,825 A 5/1989 Chino et al.
5,568,842 A * 10/1996 Otani ..... F01M 1/02 123/196 AB
5,887,563 A 3/1999 Shudo et al.
6,199,543 B1 * 3/2001 Bedkowski ..... F01M 13/04 123/572
7,270,105 B2 9/2007 Furuya
8,578,906 B2 * 11/2013 Yamada ..... F01M 11/064 123/196 R
9,157,348 B2 10/2015 Hodges
2004/0112677 A1 * 6/2004 Ito ..... F16H 57/04 184/6.5
2011/0067669 A1 * 3/2011 Sugiyama ..... F01M 11/065 123/196 R
2016/0265404 A1 * 9/2016 Fujii ..... F01M 13/0416
2017/0356315 A1 * 12/2017 Miyasaka ..... F01L 1/053
2019/0032527 A1 * 1/2019 May ..... F01M 11/02
2019/0107031 A1 * 4/2019 Christensen ..... F01N 13/10
2019/0120369 A1 * 4/2019 Staake ..... F16H 57/045

* cited by examiner

*Primary Examiner* — Long T Tran
(74) *Attorney, Agent, or Firm* — Taft Stettinius & Hollister LLP

(57) ABSTRACT

Systems, apparatus, and methods are disclosed that include an internal combustion engine having a lubrication system with an upper storage reservoir for receiving lubrication fluid from the internal combustion engine. The upper storage reservoir maintains a supply of lubrication fluid to a lower storage reservoir even while the internal combustion engine is inclined due to operation along severe grades. The lower storage reservoir supplies fluid for circulation to the internal combustion engine.

20 Claims, 3 Drawing Sheets

ON-ENGINE LUBRICATION FLUID STORAGE SYSTEM

STATEMENT REGARDING FEDERALLY SPONSORED RESEARCH

This invention was made with government support under NAMC Project Agreement No. 69-201502 awarded by the National Advanced Mobility Consortium (NAMC), Inc. The government has certain rights in the invention.

FIELD OF THE INVENTION

This invention relates to an internal combustion engine including a lubrication system, and more particularly to an on-engine lubrication fluid storage system that is separated from the crankcase.

BACKGROUND

The cylinders and other components in an internal combustion engine require lubrication by oil or other suitable fluid to be able to operate properly. For vehicles operating over steep inclines and other severe grade conditions, the ability of the crank case to supply lubrication fluid may be compromised. Furthermore, engine packaging requirements may require engine configurations which further exasperate these issues, and may create additional issues such as cylinder flooding while operating on severe inclines or grades. Therefore, further improvements in lubrication fluid storage and delivery are needed.

SUMMARY

Embodiments include an internal combustion engine including an on-engine lubrication fluid storage system that is separated from the crankcase to provide effective management and supply of the lubrication fluid even while operating at sever inclines or grades, such as at grades greater than 50%. The lubrication fluid storage system includes an upper storage reservoir and a lower storage reservoir that are both located on-engine and connected to one another via at least two passages through a block of the engine so that a supply of lubrication fluid remains available for distribution to the engine components regardless of the angular orientation of the engine due to operation over a severe incline or grade.

This summary is provided to introduce a selection of concepts that are further described below in the illustrative embodiments. This summary is not intended to identify key or essential features of the claimed subject matter, nor is it intended to be used as an aid in limiting the scope of the claimed subject matter. Further embodiments, forms, objects, features, advantages, aspects, and benefits shall become apparent from the following description and drawings.

DESCRIPTION OF ILLUSTRATIVE EMBODIMENTS

Figure 2:
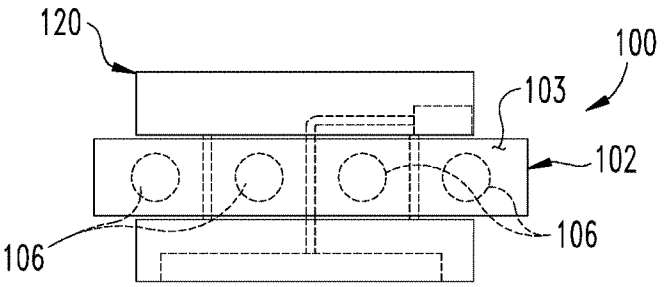
FIG. 2 is a schematic depiction of a side view of the internal combustion engine and on-engine lubrication fluid storage system of FIG. 1.

For the purposes of promoting an understanding of the principles of the invention, reference will now be made to the embodiments illustrated in the drawings and specific language will be used to describe the same. It will nevertheless be understood that no limitation of the scope of the invention is thereby intended, any alterations and further modifications in the illustrated embodiments, and any further applications of the principles of the invention as illustrated therein as would normally occur to one skilled in the art to which the invention relates are contemplated herein.

Figure 1:
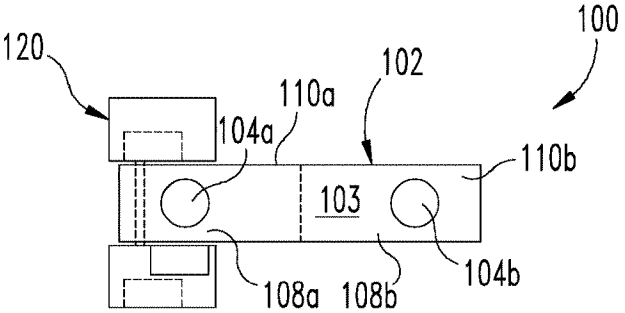
FIG. 1 is a schematic depiction of an end view of a vehicle system including an internal combustion engine and an on-engine lubrication fluid storage system.

Referring to FIGS. 1-2, a vehicle system 100 includes an internal combustion engine 102 with a block 103 housing a plurality of components such as crankshafts 104*a*, 104*b*, a plurality of cylinders 106, and crankcases 108*a*, 108*b* associated with respective ones of the first and second cylinder banks 110*a*, 110*b*. Other components are also contemplated but not illustrated, such as pistons, gears, pumps, housings, turbines, etc. that would normally be found on an internal combustion engine. The vehicle system 100 further includes a lubrication fluid storage system 120 that is mounted on-engine to receive lubrication fluid, such as oil, from at least one of the crankcases 108*a*, 108*b* and to return the lubrication fluid to the plurality of components for lubrication and/or cooling.

The internal combustion engine 102 may be coupled to a transmission (not shown), which may be a part of a powertrain for propelling a vehicle driven by engine 102 via wheels, tracks, etc. The engine 102 may be any type of internal combustion engine that requires lubrication, including at least a diesel, gasoline, or natural gas engine, and/or combinations thereof. In the illustrated embodiment of FIGS. 1-2, the vehicle system 100 includes an internal combustion engine 102 having a dual cylinder bank 110*a*, 110*b* that each includes four (4) horizontally oriented cylinders 106 for illustration purposes only. However, other numbers of cylinders and cylinder arrangements, including engines with a single cylinder bank, and other horizontal or inclined cylinder arrangements, are also contemplated for internal combustion engine 102.

Figure 3:
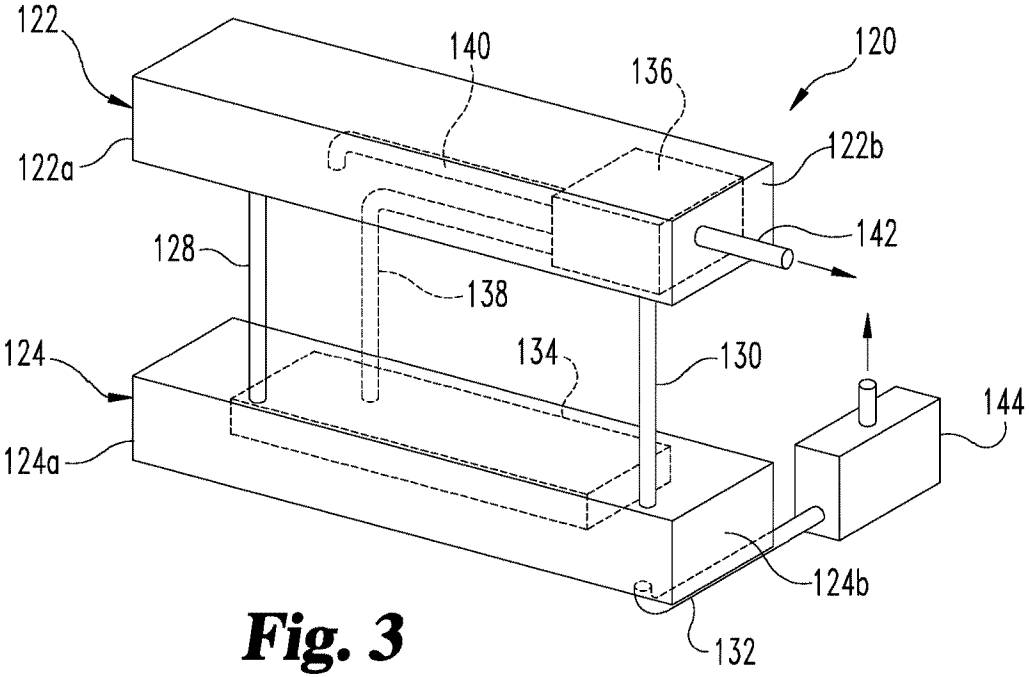
FIG. 3 is a schematic depiction of a perspective view of the lubrication fluid storage system of FIG. 1.
Figure 4:
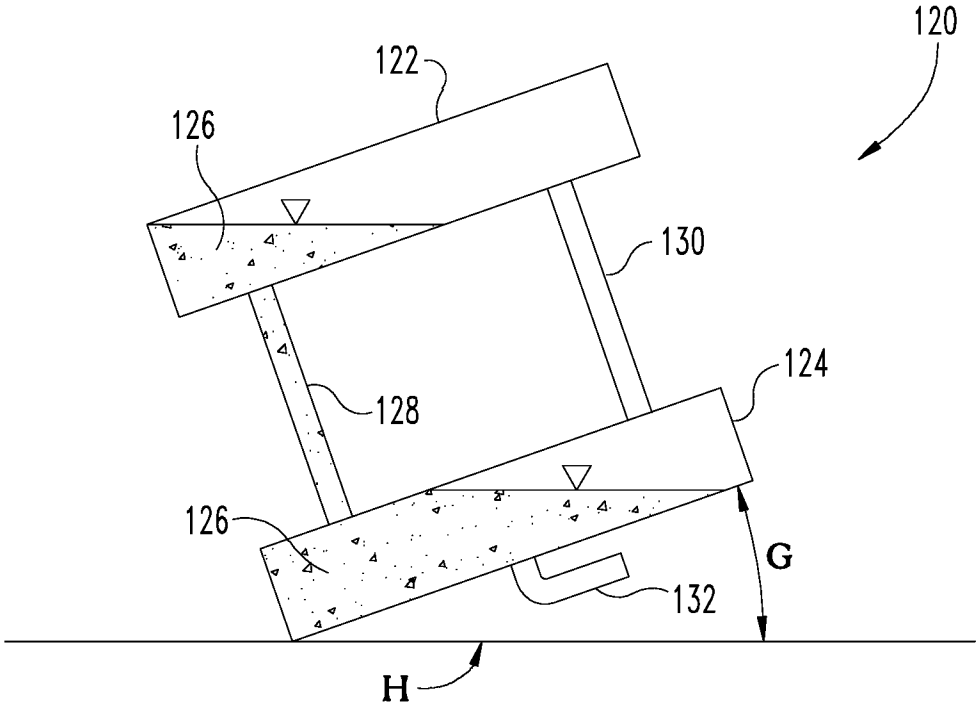
FIG. 4 is a schematic depiction of a side view of the lubrication fluid storage system tilted on a grade.

Referring further to FIG. 3, the lubrication fluid storage system 120 includes an upper storage reservoir 122 and a lower storage reservoir 124 for storing lubrication fluid 126 (FIG. 4.) Upper storage reservoir 122 can be mounted directly or indirectly on an upper surface of engine block 103 and receives lubrication fluid from one or both of crankcases 108*a*, 108*b* to provide a supply of lubrication fluid to lower storage reservoir 124. Lower storage reservoir 122 can be mounted directly or indirectly on a bottom of engine block 103 and receives lubrication fluid from upper storage reservoir 122. Upper and lower storage reservoirs 122, 124 are located on one side of engine 102, such as adjacent to a lateral edge of the side of block 103 housing cylinder bank 110*a*. Other embodiments contemplate that upper and lower storage reservoirs 122, 124 are located on the other side of block 103 housing cylinder bank 110*b*, or located on a side of a block 103 that just includes a single cylinder bank.

A first passage 128 and a second passage 130 are provided through engine block 103 to connect upper storage reservoir 122 with lower storage reservoir 124 to provide the lubrication fluid to lower reservoir 124. In the illustrated embodiment, each of the reservoirs 122, 124 is elongated between opposite ends 122*a*, 122*b* and opposite ends 124*a*, 124*b*, respectively. The direction of elongation extends in the rearward-forward direction of the internal combustion engine 102, i.e. in the direction of travel of the vehicle system 100. First passage 128 is located or offset toward or adjacent to ends 122*a*, 124*a* of reservoirs 122, 124. In addition, second passage 130 is located or offset toward or adjacent to ends 122*b*, 124*b* of reservoirs 122, 124. Other embodiments contemplate that more than two passages are provided to connect reservoirs 122, 124.

As shown in FIG. 4, the arrangement of passages 128, 130 at or adjacent the ends of the storage volumes 122, 124 allows one of the passages 128, 130 to remain in contact with or submerged in the lubrication fluid 126 even if the vehicle system 100 operates along an incline or grade G that deviates substantially from horizontal grade H. Therefore, a constant supply of lubrication fluid from upper storage reservoir 122 can be maintained to lower storage reservoir 124 even at severe grades G up to and greater than 50%. In one embodiment, the passages 128, 130 are arranged to provide a continuous supply of lubrication fluid to lower storage reservoir 124 at grades G up to 65%. The lower storage reservoir 124 includes a lubrication fluid outlet 132 that is therefore always supplied with lubrication fluid 126 supplied to lower storage reservoir 124 for distribution to the plurality of components of the internal combustion engine 102.

Returning to FIG. 3, the lower storage reservoir 124 includes a scavenge pump 134 housed therein that receives the fluid from the crankcase 108*a* and/or components of cylinder bank 110*a*. The scavenge pump 134 can be mounted directly to the underside of engine block 103 to receive the lubrication fluid from the engine components while being fluidly isolated from lower storage reservoir 124. Scavenge pump 134 is connected to an air/fluid separator 136 adjacent to or located within the upper reservoir 122 with a third passage 138 that extends through block 103.

The returned lubrication fluid 126 from the engine components and/or crankcase 108*a* is pumped by scavenge pump 134 to pass through the air/fluid separator 136 so that the separated lubrication fluid can be returned to and stored in upper storage reservoir 122 via a fluid outlet 140 of air/fluid separator 136. The air separated by the air/fluid separator 136 is outlet to a breather via an air outlet 142 of air/fluid separator 136. The lubrication fluid 126 in lower storage reservoir 124 is provided via a lubrication fluid outlet 132 to a lubrication fluid pump 144 for circulation to the plurality of components of engine 102.

Figure 5:
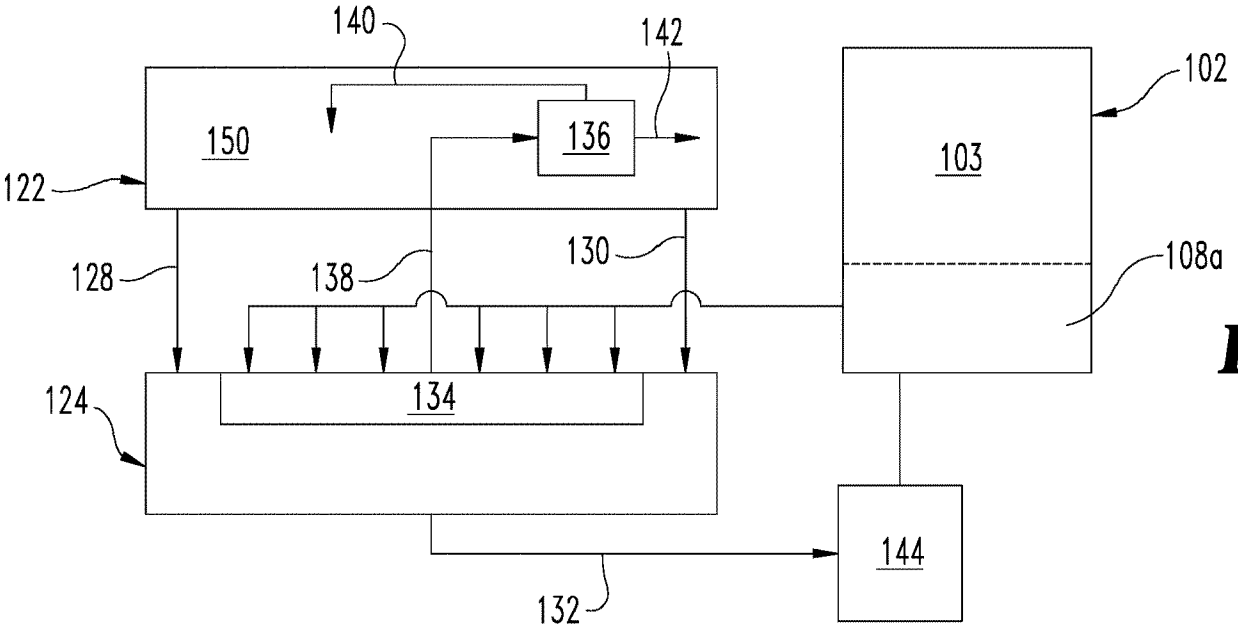
FIG. 5 is a schematic diagram of a side view of the internal combustion engine system showing a flow of the lubrication fluid therein.

Referring to FIG. 5, as discussed above, lubrication fluid 126 may drain to a crankcase 108*a* and/or be collected by scavenge pump 134 from various engine components, such as the cylinders and gear and turbine housings, and supplied to air/fluid separator 136 through third passage 138. The separated lubrication fluid is supplied to an internal storage volume 150 of upper storage reservoir 122 via a fluid outlet or connection 140 of the air/fluid separator 136. Lubrication fluid 126 can then be supplied to an internal volume 152 of lower storage reservoir 128 via one or both of passages 128, 130 from the internal volume 150 of upper reservoir 122.

Figure 6:
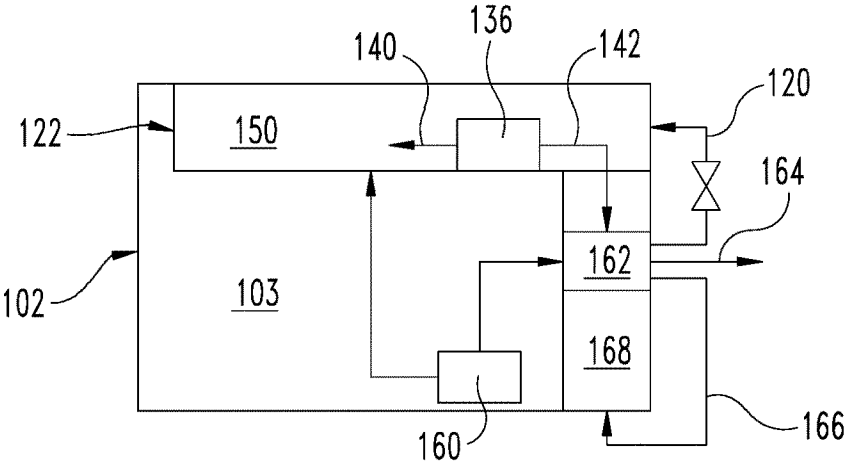
FIG. 6 is a schematic diagram of a top view of the internal combustion engine system showing a flow of an air/fluid separation system.

Referring now to FIG. 6, there is shown a top schematic view of the internal combustion engine 102 with a second air/fluid separator 160 that receives lubrication fluid from a second scavenge pump (not shown) associated with the components of the other engine bank 110*b* for embodiments with multiple cylinder banks. The second air/fluid separator 160 provides lubrication fluid from the other cylinder bank 110*b* to internal volume 150 of upper storage reservoir 122. The separated air from second air/fluid separator 160 is provided to a breather 162, along with air from an air outlet or connection 142 of the air/fluid separator 136.

Breather 162 includes a breather vent 164 to vent the air that is separated from the lubrication fluid by air/fluid separators 136, 160. Breather 162 also includes a fluid drain 166 to drain lubrication fluid that may collect in breather 162 to a gear housing 168. Upper reservoir 121 can also include a vent 170 to vent air from internal volume 150 to breather 162.

Various aspects of the present disclosure are contemplated as indicated in the claims appended hereto. According one aspect, a system includes an internal combustion engine for propelling a vehicle. The internal combustion engine includes a block, a plurality of components supported by the block, and a lubrication fluid for lubricating the plurality of components. A lubrication fluid storage system is provided for storing a supply of the lubrication fluid to lubricate the plurality of components. The lubrication fluid storage system includes a lower storage reservoir for providing the lubrication fluid to circulate the plurality of components of the internal combustion engine and an upper storage reservoir for receiving the lubrication fluid collected from the plurality of components and for providing lubrication fluid to the lower storage reservoir. At least two passages connect the upper storage reservoir to the lower storage reservoir for providing lubrication fluid from the upper storage reservoir to the lower storage reservoir.

In one embodiment, the at least two passages are located adjacent opposite ends of the upper storage reservoir and the lower storage reservoir. In another embodiment, the lower storage reservoir and the upper storage reservoir are elongated in a direction defined by a forward and rearward end of the internal combustion engine. In yet another embodiment, the upper and lower storage reservoirs are mounted to the block and the at least two passages extend through the block.

In another embodiment, a return passage is provided for returning lubrication fluid collected within the lower storage reservoir to the upper storage reservoir. In one refinement, the return passage is connected to a scavenge pump located within the lower storage reservoir and an air/fluid separator located adjacent the upper storage reservoir. In a further refinement, the air/fluid separator includes a fluid connection for returning separated lubrication fluid to the upper storage reservoir and an air connection for outputting separated air to a breather.

In another embodiment, the internal combustion engine includes a first crankcase and a second crankcase, and each of the first and second crankcases is connected to the upper storage reservoir. In a refinement of this embodiment, the plurality of components includes a first set of cylinders associated with the first crankcase on a first side of the block and a second set of cylinders associated with the second crankcase on a second side of the block. In a further refinement, the first set of cylinders and the second set of cylinders are oriented horizontally and drive respective ones of first and second crankshafts. In yet another refinement, the lower storage reservoir and the upper storage reservoir are located on the first side of the block.

In another aspect, a lubrication system for an internal combustion engine includes a lower storage reservoir for providing lubrication fluid to an internal combustion engine and an upper storage reservoir for receiving the lubrication fluid from the internal combustion engine. The upper storage reservoir is connected to the lower storage reservoir via a first passage and a second passage that are spaced from one another to supply lubrication fluid from the upper storage reservoir to the lower storage reservoir through at least one of the two passages with the upper and lower storage reservoirs tilted at a grade of at least 50%.

In one embodiment, the lower storage reservoir and the upper storage reservoir are each elongated between a first end and a second end, and the first passage is located toward the first ends and the second passage is located toward the second ends. In another embodiment, the lower storage reservoir includes a scavenge pump located therein to collect the lubrication fluid from the internal combustion engine.

In one refinement, the scavenge pump is connected to supply the collected lubrication fluid to an air/fluid separator. In a further refinement, the upper storage reservoir is connected to receive the lubrication fluid from the air/fluid separator.

According to another aspect, a method includes: operating an internal combustion engine including a lubrication fluid; returning the lubrication fluid from the internal combustion engine to an upper storage reservoir; storing the lubrication fluid in the upper storage reservoir; supplying the lubrication fluid from the upper storage reservoir to a lower storage reservoir through at least one of two passages that connect the lower storage reservoir to the upper storage reservoir; and circulating fluid from the lower storage reservoir to the internal combustion engine.

In one embodiment, the method includes separating air from the lubrication fluid before returning the lubrication fluid to the upper storage reservoir. In another embodiment, the method includes collecting the lubrication fluid in a scavenge pump in the lower storage reservoir and returning the lubrication fluid to the upper storage reservoir with the scavenge pump. In yet another embodiment, supplying the lubrication fluid includes supplying the lubrication fluid from only one of the two passages in response to the internal combustion engine being inclined on a grade of at least 50%.

While the invention has been illustrated and described in detail in the drawings and foregoing description, the same is to be considered as illustrative and not restrictive in character, it being understood that only certain exemplary embodiments have been shown and described. Those skilled in the art will appreciate that many modifications are possible in the example embodiments without materially departing from this invention. Accordingly, all such modifications are intended to be included within the scope of this disclosure as defined in the following claims.

In reading the claims, it is intended that when words such as "a," "an," "at least one," or "at least one portion" are used there is no intention to limit the claim to only one item unless specifically stated to the contrary in the claim. When the language "at least a portion" and/or "a portion" is used the item can include a portion and/or the entire item unless specifically stated to the contrary.

What is claimed is:

1. A system, comprising:

an internal combustion engine for propelling a vehicle, the internal combustion engine including a block, a plurality of components supported by the block, and a lubrication fluid for lubricating the plurality of components;

a lubrication fluid storage system for storing a supply of the lubrication fluid to lubricate the plurality of components, the lubrication fluid storage system including:

a lower storage reservoir for storing the lubrication fluid to circulate to the plurality of components of the internal combustion engine;

an upper storage reservoir for receiving the lubrication fluid collected from the plurality of components and for providing lubrication fluid to the lower storage reservoir; and at least two passages connecting the upper storage reservoir to the lower storage reservoir for providing lubrication fluid from the upper storage reservoir to the lower storage reservoir.

2. The system of claim 1, wherein the at least two passages are located adjacent opposite ends of the upper storage reservoir and the lower storage reservoir.

3. The system of claim 1, further comprising a return passage for returning lubrication fluid collected within the lower storage reservoir to the upper storage reservoir.

4. The system of claim 3, wherein the return passage is connected to a scavenge pump located within the lower storage reservoir and an air/fluid separator located adjacent the upper storage reservoir.

5. The system of claim 4, wherein the air/fluid separator includes a fluid connection for returning separated lubrication fluid to the upper storage reservoir and an air connection for outputting separated air to a breather.

6. The system of claim 1, wherein the internal combustion engine includes a first crankcase and a second crankcase, and each of the first and second crankcases is connected to the upper storage reservoir.

7. The system of claim 6, wherein the plurality of components includes a first set of cylinders associated with the first crankcase on a first side of the block and a second set of cylinders associated with the second crankcase on a second side of the block.

8. The system of claim 7, wherein the first set of cylinders and the second set of cylinders are oriented horizontally and drive respective ones of first and second crankshafts.

9. The system of claim 7, wherein the lower storage reservoir and the upper storage reservoir are located on the first side of the block.

10. The system of claim 1, wherein the lower storage reservoir and the upper storage reservoir are elongated in a direction defined by a forward and rearward end of the internal combustion engine.

11. The system of claim 1, wherein the upper and lower storage reservoirs are mounted to the block and the at least two passages extend through the block.

12. A lubrication system for an internal combustion engine, comprising:

a lower storage reservoir for providing lubrication fluid to an internal combustion engine;

an upper storage reservoir for receiving the lubrication fluid from the internal combustion engine, wherein the upper storage reservoir is connected to the lower storage reservoir via a first passage and a second passage that are spaced from one another to supply lubrication fluid from the upper storage reservoir to the lower storage reservoir through at least one of the two passages with the upper and lower storage reservoirs tilted at a grade of at least 50%.

13. The system of claim 12, wherein the lower storage reservoir and the upper storage reservoir are each elongated between a first end and a second end, and the first passage is located toward the first ends and the second passage is located toward the second ends.

14. The system of claim 12, wherein the lower storage reservoir includes a scavenge pump located therein to collect the lubrication fluid from the internal combustion engine.

15. The system of claim 14, wherein the scavenge pump is connected to supply the collected lubrication fluid to an air/fluid separator.

16. The system of claim 15, wherein the upper storage reservoir is connected to receive the lubrication fluid from the air/fluid separator.

17. A method, comprising:

operating an internal combustion engine including a lubrication fluid;

returning the lubrication fluid from the internal combustion engine to an upper storage reservoir;

storing the lubrication fluid in the upper storage reservoir;

supplying the lubrication fluid from the upper storage reservoir to a lower storage reservoir through at least one of two passages that connect the lower storage reservoir to the upper storage reservoir; and circulating fluid from the lower storage reservoir to the internal combustion engine.

18. The method of claim 17, further comprising separating air from the lubrication fluid before returning the lubrication fluid to the upper storage reservoir.

19. The method of claim 17, further comprising collecting the lubrication fluid in a scavenge pump in the lower storage reservoir and returning the lubrication fluid to the upper storage reservoir with the scavenge pump.

20. The method of claim 17, wherein supplying the lubrication fluid includes supplying the lubrication fluid from only one of the two passages in response to the internal combustion engine being inclined on a grade of at least 50%.

* * * * *